United States Patent [19]

Lecoffre et al.

[11] Patent Number: 4,909,635

[45] Date of Patent: Mar. 20, 1990

[54] STATIC DEVICE FOR HOMOGENIZING A FLOWING FLUID

[75] Inventors: Yves Lecoffre, Pitres; Gérald Rieux, Grenoble, France

[73] Assignee: Societe Anonyme dite: ALSTHOM, Paris, France

[21] Appl. No.: 292,794

[22] Filed: Jan. 3, 1989

[30] Foreign Application Priority Data

Jan. 5, 1988 [FR] France ..... 88 00033

[51] Int. Cl.[4] ..... B01F 3/08

[52] U.S. Cl. ..... 366/337; 366/340

[58] Field of Search ..... 366/386, 337, 338, 340, 366/341; 138/12, 13

[56] References Cited

U.S. PATENT DOCUMENTS

| | | | |
|---|---|---|---|
| 2,740,616 | 4/1956 | Walden | 366/336 |
| 3,617,305 | 1/1965 | Backx et al. | 366/340 X |
| 4,043,539 | 8/1977 | Gilmer et al. . | |
| 4,189,243 | 2/1980 | Black | 366/336 |
| 4,386,855 | 6/1983 | Neal, Jr. et al. | 366/340 X |
| 4,408,892 | 10/1983 | Combes et al. | 366/337 |
| 4,560,284 | 12/1985 | Chen . | |
| 4,632,568 | 12/1986 | Emele et al. . | |

FOREIGN PATENT DOCUMENTS

| | | |
|---|---|---|
| 0064137 | 10/1982 | European Pat. Off. . |
| 1208294 | 2/1963 | Fed. Rep. of Germany . |

*Primary Examiner*—Frankie L. Stinson

*Attorney, Agent, or Firm*—Sughrue, Mion, Zinn, MacPeak & Seas

[57] ABSTRACT

A liquid to be homogenized passes successively through two perforated walls (TA, TB) forming jets (F2, F6) on passing therethrough for performing stirring. These two walls extend longitudinally over a common length of the axis (A) of the device. The liquid passes from one to the other by following a circumferential path (F4) and its direction of longitudinal flow is reversed, locally (F5). The invention is particularly applicable to measuring the concentration of one of the components in a mixture.

9 Claims, 5 Drawing Sheets

STATIC DEVICE FOR HOMOGENIZING A FLOWING FLUID

The present invention relates to homogenizing a fluid, e.g. a liquid flowing along a pipeline. The invention is particularly applicable when the liquid includes two immiscible phases. A device in accordance with the invention is intended, for example, for homogenizing a mixture of oil and water flowing along a horizontal transport pipeline in order to make it possible to measure the water content of this mixture accurately.

Such measurements are normally performed on samples taken periodically and automatically from the pipeline, and in order to ensure that the measurements performed on the samples taken are indeed representative of the overall composition of a given fluid, it is necessary to ensure that the sampled fluid is itself homogenous. Unfortunately, the components of such a mixture have a natural tendency to separate from each other, at least when the speed of flow is low, e.g. less than 1 meter per second (m/x). It is therefore necessary to use a homogenizing device a little way upstream from the point where samples are taken.

Homogenization may also be useful in the following situations:

when a pipeline is transporting a multiphase fluid whose phases tend to separate out (e.g. because of gravity), and such separation gives rise to operating difficulties, or abnormal corrosion or wear in the pipeline itself;

upstream from the connection point of a secondary pipeline which supplies a user with the transported fluid, this being for the purpose of ensuring that the user receives a product in which both phases are in the proper proportions; and whenever it is desirable to mix two liquid components in line for the purpose of manufacturing a product.

The present invention relates to those situations in which homogenization is useful and where the energy used by the homogenizing device is taken from the fluid to be homogenized itself. As a result the fluid suffers headloss as it flows through the device. Such a device is termed "static" and it does not include any moving parts, thereby simplifying construction thereof.

A static homogenizing device is described in patent document EP-A-0064137 (Alsthom) and in corresponding U.S. patent US-A-4 408 892.

The device described in said document includes various dispositions which are common, at least to some extent, between said prior device and the device of the present invention, and these dispositions are set forth initially, as follows:

The device comprises:

an inlet having an axis and a diameter for receiving an inlet flow of said fluid along said axis at an upstream end of said device;

an outlet having the same axis and the same diameter for restoring an outlet flow of said fluid along said axis from a downstream end of said device, said axis being an axis of the device and having a longitudinal direction which is perpendicular to transverse directions which are, in particular, radial directions and circumferential directions, said diameter being the diameter of a reference surface which is cylindrical and coaxial with said devices; and mixing chambers connected between said inlet and said outlet and each comprising a feed compartment and a stirring compartment, which compartments are separated by a perforated wall, each of said mixing chambers being connected to receive streams of said flow in said feed compartment and to form a plurality of jets which are perpendicular to said wall and which penetrate into said stirring compartment in order to stir said fluid therein, said wall extending longitudinally and along a first one of said transverse directions in order to provide a large area in a radially limited space, such that said jets have speed components along a second one of said transverse directions perpendicular to the first transverse direction, said feed and stirring compartments being further delimited by inlet and outlet guide walls leaving open an inlet of said chamber in said feed compartment and an outlet of said chamber in said stirring compartment, said guide walls extending facing said perforated wall in such a manner as to confer to said flow a direction which is substantially parallel to said perforated wall in each of said compartments, with said streams curving on either side of said perforated wall;

said perforated walls being at least partially contained in said reference surface and being longitudinally coextensive in such a manner as to limit the longitudinal and radial size of the device; and said mixing chambers being offset transversely relative to one another along a transverse offset direction.

In this prior device, and assuming its axis is horizontal, two feed compartments and two quasi-horizontal plane perforated walls (see FIGS. 2 and 6) feed an interposed stirring compartment which is separated off by transverse internal partitions. Within said compartment, said jets interpenetrate quasi-vertically, and curve sideways through a right angle. The liquid stream return to the direct longitudinal direction via a second right angle curve in the vicinity of the cylindrical outer envelope.

The two perforated plates are disposed symmetrically on either side of a horizontal axial plane and they are thus longitudinally coextensive. Said partitioned-off mixing compartment is imprisoned therebetween. It may be assumed that together with the outer envelope they form two mixing chambers which are symmetrically disposed relative to the horizontal axial plane and in which the stirring compartments are situated on either side of said plane without a separating wall. As a result it appears that these two symmetrical chambers have two halves of the liquid flow running through them in parallel.

The main purpose of this prior device is to obtain emulsification, i.e. to reduce the diameter of the droplets of the dispersed phase with the final diameter thereof being a function of the head loss through the apparatus. The homogenizing function occurs both inside the device and immediately downstream therefrom. However, this function is not always performed as efficiently and/or with as low a head loss as could be desired.

Particular aims of the present invention are to obtain good homogenizing within a device which is simple and compact, and which imposes a very moderate head loss to the flow of fluid to be homogenized.

The present invention provides a device which includes the common dispositions specified above. Compared with the above-described prior art device, the device of the invention is characterized by the fact that it includes transfer means for connecting the outlet from a first of said mixing chambers to the inlet of a second of said mixing chambers so as to connect said two chambers in series while causing the same stream of said flow to flow through both of them in succession.

According to the present invention, it is also possible to adopt the following sometimes-preferred dispositions:

said inlet and outlet guide walls confer a substantially longitudinal direction to said flow in each of said feed and stirring compartments of each mixing chamber, said walls including a main guide wall facing said perforated wall and inclined relative to said perforated wall in such a manner as to extend away therefrom towards said inlet and said outlet of said mixing chamber, respectively;

said transfer means comprising at least one transfer chamber extending along said offset direction; and said device comprising a succession of an even number of reversing chambers on the path of each stream of said flow each of said chambers reversing the longitudinal components of the average speed of the fraction of said flow which flows therealong, with at least one of said reversing chambers being constituted by said transfer chamber; and each of said transfer chambers extends from a single one of said upstream and downstream ends of the set of said mixing chambers, connects two of said chambers directly, and constitutes a single one of said reversing chambers, thereby enabling the device to be embodied simply.

An implementation of the present invention within the scope of the explanation given above is now described in greater detail by way of non-limiting example and with reference to the accompanying diagrammatic figures. When the same item appears in several figures it is designated therein by the same reference symbol. Three devices constituting three implementations of the invention are given by way of example. They include the above-mentioned sometimes-preferred dispositions. It should be understood that the items mentioned may be replaced by other items which provide the same technical functions.

Figure 1:
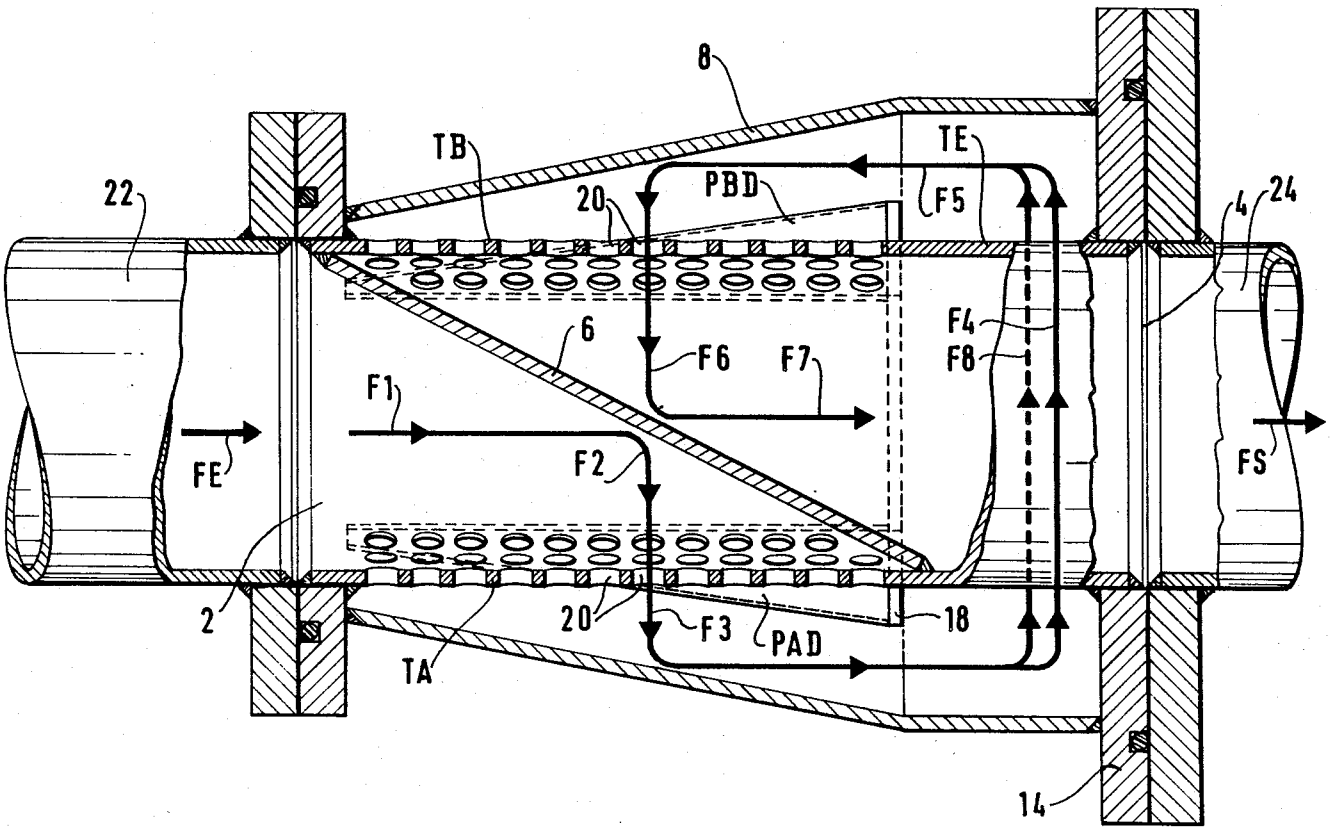
FIG. 1 is an axial section through a first device in accordance with the invention.
Figure 2:
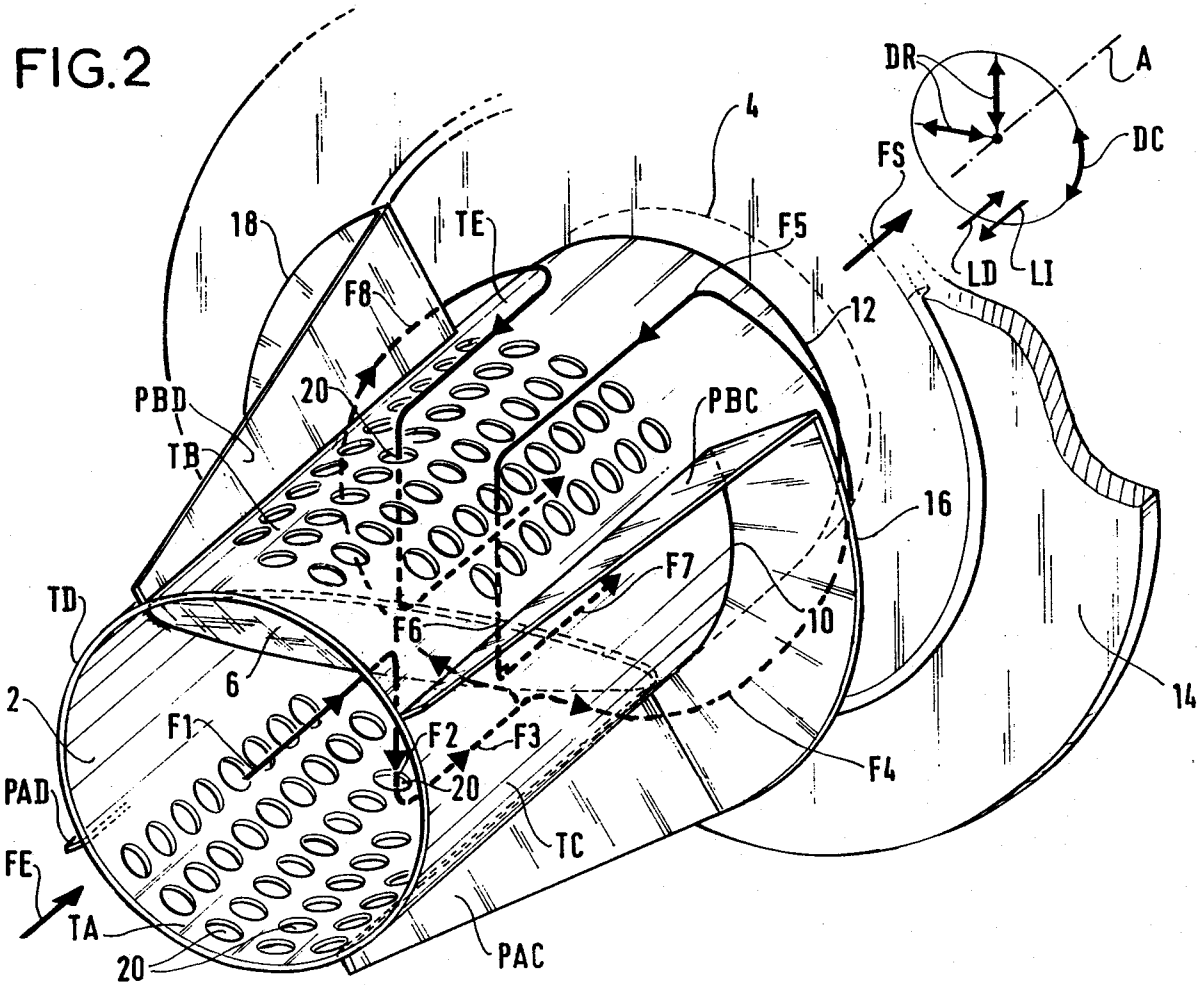
FIG. 2 is a fragmentary perspective view of the FIG. 1 device.
Figure 3:
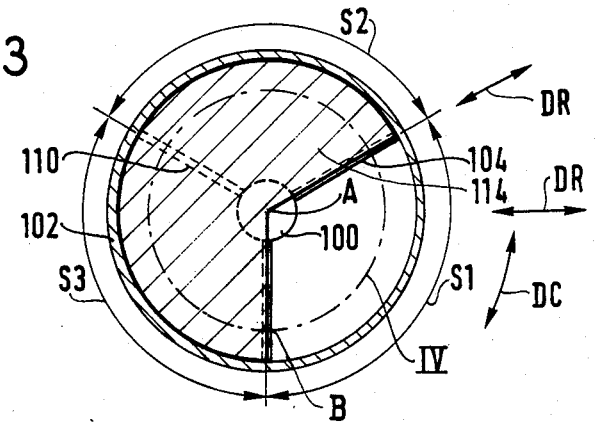
FIG. 3 is a view of a second device in accordance with the invention shown in cross-section on line III-III of FIG. 3.
Figure 4:
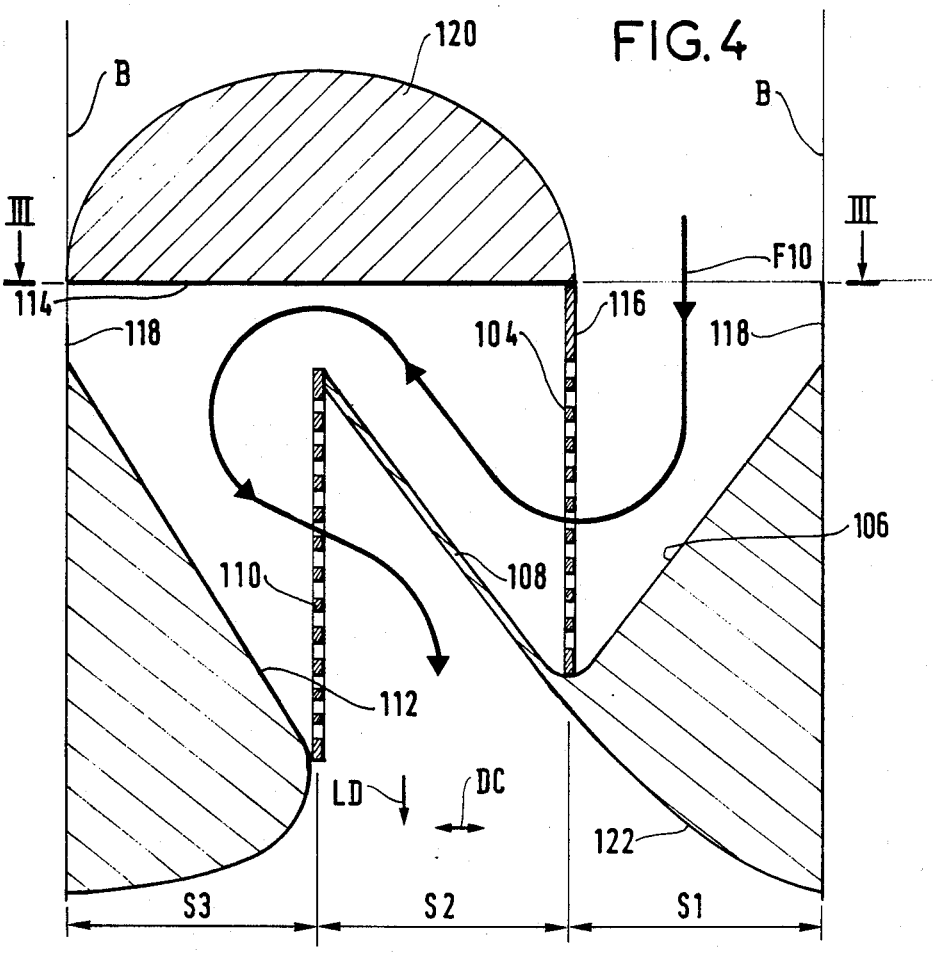

FIG. 4 shows the FIG. 3 device in section on a cylindrical surface of revolution about the axis A of the device, with said surface being represented in FIG. 3 by line IV, said section surface being taken as being split along a generator line B shown by a point in FIG. 3 and by two straight lines in FIG. 4, with said section surface then being assumed to be developed and laid out flat to constitute FIG. 4.

Figure 5:
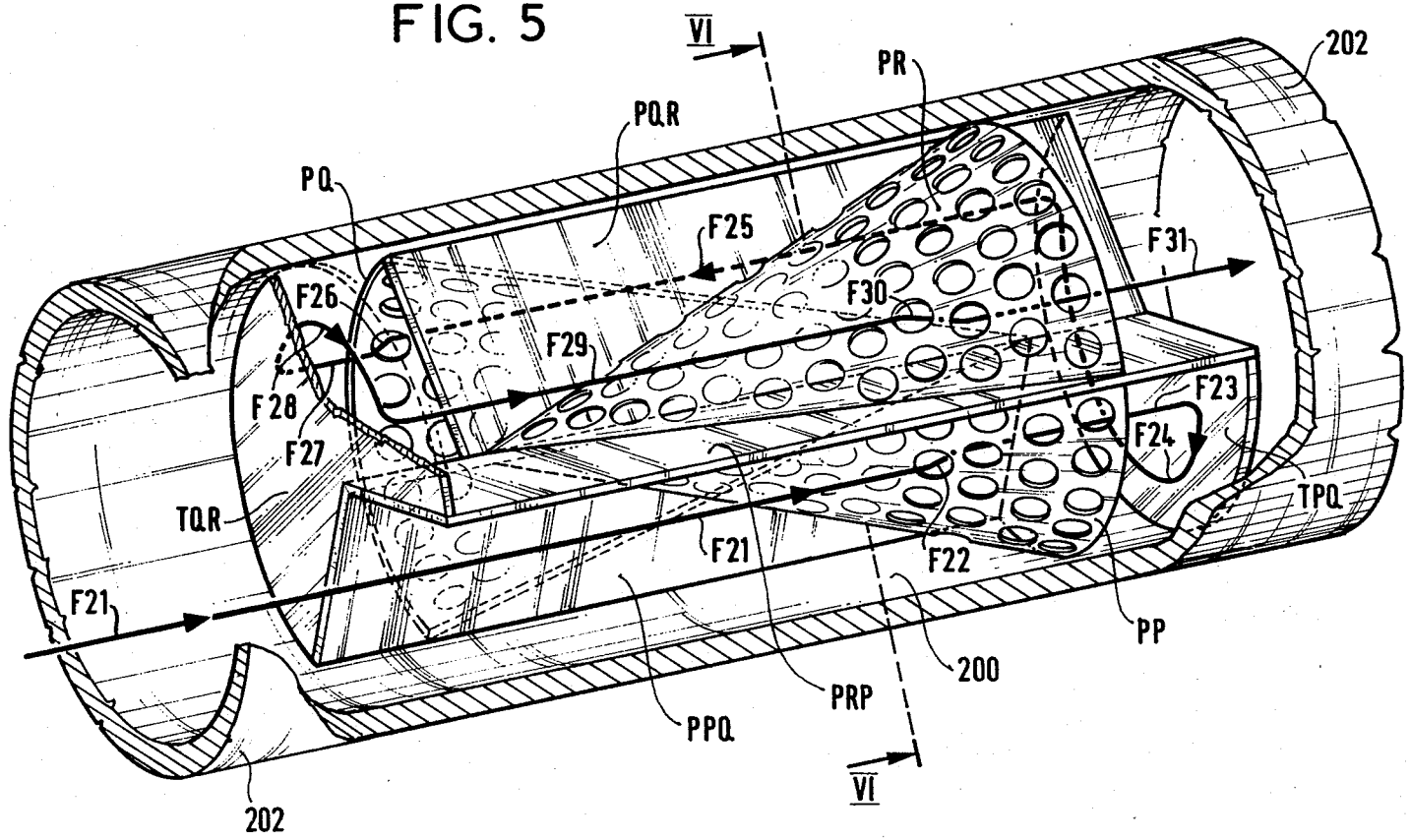

FIG. 5 is a partially cut-away perspective view of a third device in accordance with the invention.

Figure 6:
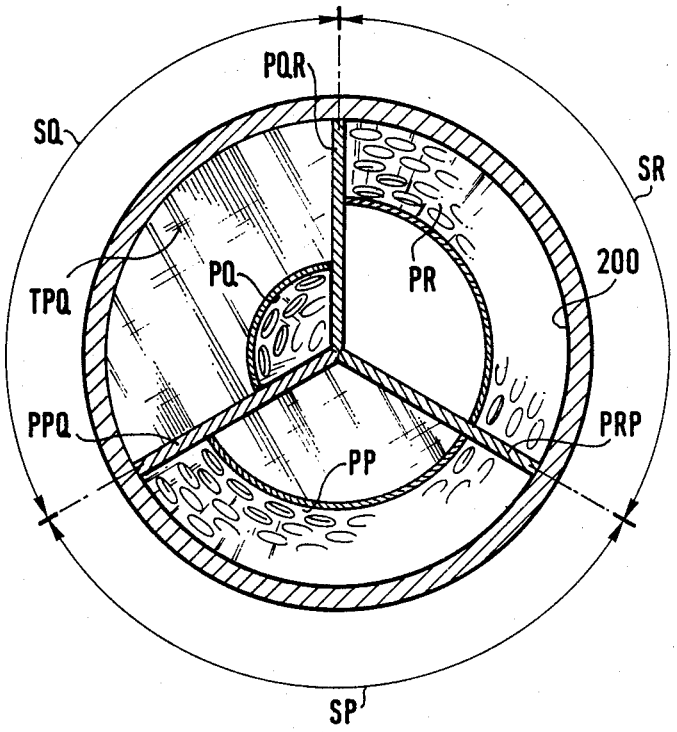

FIG. 6 is a cross-section on line VI-VI through the FIG. 5 device.

In order to simplify the explanation of the three devices in accordance with the invention, they are assumed to have a common axis A defining a forward longitudinal direction LD and a reverse longitudinal direction LI, and also defining transverse directions such as a circumferential direction DC and a radial direction DR.

Chambers are designated below by means of the references for the walls which delimit said chambers. Any part comprising a plurality of portions is designated by the references for said portions.

The first and second devices in accordance with the invention both have the following dispositions:

There are two of said mixing chambers, i.e. a first chamber and a second chamber including first and second ones of said perforated walls separating first and second ones of said feed compartments from first and second ones of said stirring compartments, with the inlet to said first chamber and the outlet from said second chamber respectively constituting the inlet and the outlet of the device, one of said two chambers being one of said reversing chambers, and the number of said transfer chambers being one on the path of each stream of said flow.

Initially in general terms, in the first device of the invention, said two perforated walls are formed in two angular sectors TA and TB of a tube TA, TB, TC, TD, and TE which is coaxial with said device such that said first and second transverse directions are respectively circumferential and radial. This tube has two openings at its respective ends constituting the inlet 2 and the outlet 4 of the device. A sloping separator wall 6 closes off the inside volume of said tube in such a manner that said two perforated walls face respective ones of the two faces of said separating plate. Said first perforated plate TA and said separating plate 6 delimit said feed compartment TC, TA, TD, and 6 of said first mixing chamber. Said second perforated plate TB and the same separating plate delimit said stirring compartment TC, TB, TD, and 6 of said second mixing chamber. The perforations through the walls TA and TB are referenced 20.

The device also includes an envelope 8 having longitudinal and circumferential extent and situated radially beyond said tube, at least facing said two perforated plates, and two lateral guide walls PAC, PAD and PBC, PBD extending longitudinally and radially and situated angularlay on either side of each of said two perforated plates in order to constitute together with said envelope 8, said stirring chamber TA, PAC, PAD, and 8 of said first mixing chamber, and said feed compartment TB, PBC, PBD, and 8 of said second mixing chamber.

Said tube is extended by an additional non-perforated length TE e.g. on the same end as the set of said two mixing chambers. This length extends angularly over the two angular sectors of said two perforated walls TA and TB and at least over an angular transfer sector TC, TD interconnecting the two preceding sectors. It extends longitudinally from an internal edge 10 adjacent to said perforated walls up to an external edge 12. Said envelope 8 extends facing said non-perforated length TE. The device also includes an external transfer transverse wall 14 extending radially and circumferentially and connecting said external edge 12 of said non-perforating length to said envelope 8, and at least one internal transfer transverse wall 16 extending radially and circumferentially and connecting said internal edge 10 of said non-perforated length TE to said envelope 8 in said transfer angular sector in such a manner that said non-perforated length, said envelope facing said length, and said two transfer transverse walls constitute said transfer chamber TE, 8, 14, and 16, with said offset direction DC being circumferential.

More particularly, this first device comprises two opposing ones of said transfer angular sectors TC and TD forming a complete tube with the two angular sectors of said two perforated walls TA and TB. Said envelope 8 is a coaxial conical wall which flares towards said non-perforated length TE while constituting said two transfer chambers TE, 14, 8, & 16, and TE, 14, 8, & 18 which are connected in parallel and which comprise respective ones of said two transfer internal walls 16 and 18, thereby constituting a simple structure which is symmetrical about two diametrically perpendicular planes.

Said two transfer chambers are symmetrical to each other about a vertical axial plane, and said two mixing chambers are symmetrical to each other about a horizontal axial plane.

Successive liquid streams, i.e. successive lengths of the path of a liquid molecule are designated by the following references:

F1, F2, and F3 including two right angle bends through a first mixing chamber;

F4 in a circular arc through a transfer chamber with two right angle bends at each end in order to switch from the forward longitudinal direction LD in the two compartments of the first mixing chamber to the reverse longitudinal direction LI in the inlet compartment of the second mixing chamber; and F5, F6, F7 through said second mixing chamber with two right angle bends and returning to the forward longitudinal direction in the stirring chamber.

A length of stream symmetrical to the stream F4 is shown at F8 as passing through the other transfer chamber. These two streams meet at both ends.

The tube TA, TB, TV, TF, and TE is aligned between two lengths 22 and 24 of an external same-diameter pipeline.

The envelope 8 projects outwardly from said pipeline. The connection of said tube between two lengths of said pipeline is easily performed and gives rise to no connection head loss, i.e. no head loss other than that produced inside the device for the purpose of providing the desired homogenization.

The second device in accordance with the invention includes an axial core 100 and a cylindrical envelope 102 about said axis A. Said mixing chambers and transfer chambers follow one another circumferentially and longitudinally in the annular gap between said core and said envelope. Each of said mixing chambers includes one of said plane perforated walls 104, 110 extending radially and longitudinally, with said first and second transverse directions being the radial direction DR and the circumferential direction DC, respectively.

In FIG. 4, the radial direction DR is perpendicular to the sheet of paper at all points of the figure.

Two of the said feed and stirring compartments of said chamber are formed by said perforated wall and by two helical guide walls 106 and 108 for one of the chambers and 108 and 112 for the other chamber. One of these two walls is a separating wall 108 which is common to both chambers. The mixing chamber 106, 108 constitutes one of said reversing chambers, with the two said helical guide walls 106 and 108 of said chamber sloping in opposite directions. The two said helical guide walls 108 and 112 of the other mixing chamber slope in the same direction.

Each of said feed and stirring chambers extends, as does said guide wall 106, 108, and 112 constituting said compartment, over an angular sector S1, S2 or S3 having an extent of 120°. Two of the compartments, one 104, 108 belonging to one of said mixing chambers and the other 110, 108 belonging to the other of said mixing chamber being formed over a common angular sector S2 and being situated longitudinally on opposite sides of the separating wall 108.

Said transfer chamber includes a transfer wall 114 extending radially and circumferentially and occupying two of said 120° angular sectors S2 and S3. It also includes two link walls 116 and 118 which extend radially and longitudinally.

The path of a liquid molecule is referenced F10.

The envelope 102 connects coaxially with a same-diameter pipeline (not shown). Upstream from the wall 114 and downstream from the walls 106 and 112, respective inlet and outlet smoothing walls 120 and 122 cause the fluid flow crosssection in the pipeline to vary progressively so as to limit head loss.

A third device in accordance with the invention comprises:

A cylindrical envelope 200 about said axis A.

Three longitudinally coextensive separating walls PPQ, PQR, and PRP each extending radially from said axis to said envelope and forming three of said mixing chambers. Each of these chambers occupies an angular sector SP, SO, or SR extending over 120° about said axis, and has two longitudinal ends constituting said inlet PE and outlet PS.

Three of said perforated walls PP, PQ, and PR in respective ones of said three chambers. Each of these walls extends along a direction which slopes relative to said longitudinal and radial directions LV and LR and also extends over said circumferential direction DC so as to separate said feed compartments PPQ, PRP, PP, and PE from said stirring compartments PPQ, PEP, PP, and PS. As a result said first and second transverse directions are respectively said circumferential and radial directions, the speeds of said jets include not only said component along said second transverse direction, but also a longitudinal component, none of said mixing chambers constituted one of said reversing chambers, and said offset direction is circumferential.

Two of said transfer chambers at two respective ends of the assembly of these three mixing chambers, and within the envelope 200. These transfer chambers are offset angularly by 120°. Each of them comprises a transfer wall TPQ occupying two of said angular sectors SP and SQ at a distance beyond the end edge of said separating wall PPQ which separates these two sectors; and two link walls MRP and MQR extending the other two separating walls PQP and PRP as far as said transfer walls, thereby connecting said three mixing chambers in series.

More particularly, said perforated walls are fractions of circular cones about said axis A. The half angles at the apex of each of these cones correspond, in this case, to the angle of slope of said walls. The angle of slope of that one of these walls PQ which occupies said angular sector SO common to said two transfer walls TPQ and TQR is opposite to the angle of slope of the other two perforated walls PP and PR such that the radial component of the speed of each of said jets extends in the same direction on going through each of the three said perforated walls.

In the example given, said radial component is directed towards the axis and said angle of slope is about thirty degrees.

The successive lengths of the path followed by a molecule of fluid are labeled as follows:

F21, F22, and F23 through a first mixing chamber on either side of perforated plate PP;

F24 including two right angle bends through a downstream transfer chamber delimited by the wall TPP;

F25, F26, and F27 in a second mixing chamber on either side of perforated wall PQ;

F28 including two right angle bends through an upstream transfer chamber delimited by the wall TPQ; and F29, F30, and F31 through a third mixing chamber including perforated wall PR.

The inlet and outlet lengths are the lengths F21 and F31, respectively. Said jets through the perforated plates are lengths F22, F26, and F30.

The device connects coaxially with a pipeline 202 (not shown) having the same diameter as the envelope 200.

Upstream from the wall TQR and downstream from the wall TPQ, inlet and outlet connection walls (not shown) cause the fluid flow cross-section to vary progressively so as to minimize connection head loss.

For cases where the concentration of minority fluid to be mixed varies between 1% and 50% (with said fluid being applied at the center of the upstream section), and with the differences in the densities of the fluid to be mixed varying in the range 20/1000 to 150/1000 in relative value, and for fluids having kinematic viscosities of the order of a few centistokes, the quality of the mixture obtained is remarkable, for speeds along the pipeline in the range centimeters per second to more than a meter per second.

The tube TA, TB, TC, TD, & TE of the first device may have a diameter of 100 mm and a length of 240 mm. Under the abovespecified circumstances, the envelope 102 of the second device and the envelope 200 of the third device may have a diameter of 100 mm and a length of 450 mm, including the connection zones.

The perforated walls TA and TB in the first device may each include 50 to 60 circular holes 20 with a diameter of 10 mm.

The perforated walls 104 and 110 of the second device may each have 50 to 60 holes with a diameter of 10 mm.

The perforated plates PP, PQ, and PR of the third device may each comprise 50 to 60 holes with a diameter of 10 mm.

The sizes given correspond, for the second and third devices, to apparatus whose outside diameter is the same as the outside diameter of the pipeline.

We claim:

1. A static device for homogenizing a fluid flow, the device comprising:

an inlet (2) having an axis and a diameter for receiving an inlet flow of said fluid along said axis at an upstream end of said device;

an outlet having the same axis and the same diameter for restoring an outlet flow of said fluid along said axis from a downstream end of said device, said axis being an axis of the device and having a longitudinal direction which is perpendicular to transverse directions which are, in particular, radial directions and circumferential directions, said diameter being the diameter of a reference surface which is cylindrical and coaxial with said device; and mixing chambers connected between said inlet and said outlet and each comprising a feed compartment (TC, TA, TD, 6) and a stirring compartment which compartments are separated by a perforated wall (TA, PAC, 8, PAD), each of said mixing chambers being connected to receive streams (F1) of said flow in said feed compartment and to form a plurality of jets (F2) which are perpendicular to said wall and which penetrate into said stirring compartment in order to stir said fluid therein said wall extending longitudinally and along a first one of said transverse directions (DC) in order to provide a large area in a radially limited space, such that said jets have speed components along a second one of said transverse directions (DR) perpendicular to the first transverse direction, said feed and stirring compartments being further delimited by inlet and outlet guide walls (TC, 6, TD; PAC, 8, PAD) leaving open an inlet (2) of said chamber in said feed compartment and an outlet of said chamber in said stirring compartment, said guide walls extending facing said perforated wall in such a manner as to confer to said flow a direction (LD) which is substantially parallel to said perforated wall in each of said compartments, with said streams curving on either side of said perforated wall;

said perforated walls (TA, TB) being at least partially contained in said reference surface and being longitudinally coextensive in such a manner as to limit the longitudinal and radial size of the device; and said mixing chamber being offset transversely relative to one another along a transverse offset direction (DC);

said device being characterized by the fact that it includes transfer means (TE, 14, 8, 16) for connecting the outlet from a first of said mixing chambers (6, TC, PAC, 8, PAD, TD) to the inlet of a second of said mixing chambers (6, TD, PBD, 8, PBC, TC) so as to connect said two chambers in series while causing the same stream of said flow (F1, F2, F3, F4, F5, F6, F7) to flow through both of them in succession.

2. A device according to claim 1, characterized by the fact that said inlet and outlet guide walls (TC, 6, TD; PAC, 8, PAD) confer a substantially longitudinal direction to said flow in each of said feed and stirring compartments (TC, TA, TD, 6; TA, PC, 8, PAD) of each mixing chamber, said walls including a main guide wall (6, 8) facing said perforated wall (TA, TB) and inclined relative to said perforated wall in such a manner as to extend away therefrom towards said inlet and said outlet of said mixing chamber, respectively;

said transfer means comprising at least one transfer chamber (TE, 14, 8, 16) extending along said offset direction (DC); and said device comprising a succession of an even number of reversing chambers on the path of each stream of said flow, each of said chambers reversing the longitudinal components of the average speed of the fraction of said flow which flows therealong, with at least one of said reversing chambers being constituted by said transfer chamber.

3. A device according to claim 2, in which each of said transfer chambers (TE, 14, 8, 16) extends from a single one of said upstream and downstream ends of the set of said mixing chambers, connects two of said chambers directly, and constitutes a single one of said reversing chambers, thereby enabling the device to be embodied simply.

4. A device according to claim 3, characterized by the fact that there are two of said mixing chambers, said chambers being a first chamber (6, TC, PAC, 8, PAD, TD), and a second chamber (6, TD, PBD, 8, PBC, TC) comprising respective first (TA) and second (TB) ones of said perforated walls separating first and second ones of said feed compartments from first and second ones of said stirring compartments, the inlet (2) of said first chamber and the outlet (4) of said second chamber respectively constituting the inlet and the outlet of said device, one of said two chambers being a reversing chamber the number of said transfer chambers (TE, 14, 8, 16) on the path of each stream (F1, F2, F3, F4, F5, F6, F7) of said flow being one.

5. A device according to claim 4, characterized by the fact that said two perforated walls (TA, TB) are formed over two angular sectors of a tube (TA, TB, TC, TD, TE) constituting said reference surface;

a generally sloping separating wall (6) closing said tube while separating said two perforated walls so as to form in said tube said feed compartment (2, TC, TA, TD, 6) of a first one of said mixing chambers and said stirring compartment (4, TC, TB, TD, 6) of a second one of said mixing chambers;

said stirring compartment (TA, PAC, PAD, 8) of said first mixing chamber, said feed compartment (TB, PBC, PBD, 8) of said second mixing chamber, and said transfer means (TE, 8, 14, 16) being formed radially outside said tube inside an envelope (8);

two lateral guide walls (PAC, PAD & PBC, PBD) extending longitudinally and radially being situated angularly on either side of each of said perforated plates in order to constitute, together with said envelope (8), said stirring chamber (TA, PAC, PAD, 8) of said first mixing chamber, and said feed chamber (TB, PBC, PBD, 8) of said second mixing chamber;

said tube being extended by an additional length (TE) situated at one of said upstream or downstream ends of the assembly of said two mixing chambers inside said envelope and extending angularly over two angular sectors of said two perforates plates (TA, TB) and over at least one angular transfer sector (TC, TD) interconnecting the two preceding sectors; and an external transfer transverse wall (14) connecting said additional length to said envelope (8), and at least one internal transfer transverse wall (16) connecting said length (TE) to said envelope (8) in said transfer angular sector in such a manner that said additional length, said envelope facing said length, and said two transfer transverse walls constitute said transfer chamber (TE, 8, 14, 16).

6. A device according to claim 4, characterized by the fact that it includes an axial core (100) and a cylindrical envelope (102) substantially constituting said reference surface, said mixing and transfer chambers following one another circumferentially and longitudinally within the angular gap between said core and said envelope;

each of said mixing chambers comprising a plane one of said perforated walls (104, 110), extending radially and longitudinally and separating pairs of said feed and stirring compartments which are also delimited by two respective helical guide walls (106, 108; 108, 112) with one of the helical guide walls (108) being common to the other one of said mixing chambers;

one of said mixing chambers constituting one of said reversing chambers, with the two said helical guide walls (106, 108) of said chamber sloping in opposite directions, while the two said helical guide walls (108, 112) of the other one of said mixing chambers slope in the same direction; and one of said transfer chambers including a transfer wall (104) extending radially and circumferentially in order to interconnect said two mixing chambers.

7. A device according to claim 3, characterized by the fact that it comprises:

cylindrical envelope (200) substantially constituting said reference surface;

three longitudinally coextensive separating walls (PPQ, PQR, PRP) each extending radially from said axis towards said envelope and forming three of said mixing chambers each of which occupies an angular sector (SP, SQ, SR) about said axis, with each of said sectors having two longitudinal ends constituting its said inlet (PE) and outlet (PS);

three of said perforated walls (PP, PQ, PR) occupying respective ones of said three chambers, each of said walls extending along a direction which slopes relative to said longitudinal direction (LD) and said radial direction (DR), and which extends along said circumferential direction (DC) in such a manner as to separate said feed and stirring compartments (PPQ, PRP, PP, PE; PPQ, PEP, PP, PS) such that said first and second transverse directions are respectively said circumferential direction (DC) and said radial direction (DR), with the speeds of said jets including not only said component along said second transverse direction, but also including a longitudinal component, with none of said mixing chambers constituting any of said reversing chambers, and with said offset direction being circumferential; and two offset transfer chambers at two respective ends of the assembly of said three mixing chambers, inside said envelope (200), and with each of said two transfer chambers comprising:

a transfer wall (TPQ) occupying two of said angular sectors (SP, SQ) at a distance beyond the extreme edge of said separating wall (PPQ) which separates said two sectors; and two link walls (MRP, MQR) extending the other two of said separating walls (PQR, PRP) up to said transfer wall, thereby interconnecting all three of said mixing chambers in series.

8. A device according to claim 7, characterized by the fact that said perforated walls are fractions of circular cones about said axis (A), with the half angles at the apex of each of said cones being the slope angles of said walls, with the slope angle of that one of said walls (PQ) occupying said angular sector (SQ) which is common to both of said transfer walls (TPQ, TQR) being opposite to the slope angle of the other two said perforated walls (PP, PR) such that the radial component of the speed of said jets always passes in the same direction through said three perforated walls.

9. A static device for homogenizing a fluid flow, the device comprising:

an inlet (2) having an axis and a diameter for receiving an inlet flow of said fluid along said axis at an upstream end of said device;

an outlet having the same axis and the same diameter for restoring an outlet flow of said fluid along said axis from a downstream end of said device, said axis being an axis of the device and having a longitudinal direction which is perpendicular to transverse directions which are, in particular, radial directions and circumferential directions; and mixing chambers connected between said inlet and said outlet and each comprising a feed compartment (TC, TA, TD, 6) and a stirring compartment which compartments are separated by a perforated wall (TA, PAC, 8, PAD), each of said mixing chambers being connected to receive streams (F1) of said flow in said feed compartment and to form a plurality of jets (F2) which are perpendicular to said wall and which penetrate into said stirring compartment in order to stir said fluid therein, said wall extending longitudinally and along a first one of said transverse directions (DC) in order to provide a large area in a radially limited space, such that said jets have speed components along a second one of said transverse directions (DR) perpendicular to the first transverse direction, said feed and stirring compartments being further delimited by inlet and outlet guide walls (TC, 6, TD; PAC, 8, PAD) leaving open an inlet (2) of said chamber in said feed compartment and an outlet of said chamber in said stirring compartment, said guide walls extending facing said perforated wall in such a manner as to confer to said flow a direction (LD) which is substantially parallel to said perforated wall in each of said compartments, with said streams curving on either side of said perforated walls;

said mixing chambers being offset transversely relative to one another along a transverse offset direction (DC);

transfer means (TE, 14, 8, 16) for connecting the outlet from a first of said mixing chambers (6, TC, PAC, 8, PAD, TD) to the inlet of a second of said mixing chambers (6, TD, PBD, 8, PBC, TC) so as to connect said two chambers in series while causing the same stream of said flow (F1, F2, F3, F4, F5, F6, F7) to flow through both of them in succession;

said inlet and outlet guide walls (TC, 6, TD; PAC, 8, PAD) confer a substantially longitudinal direction to said flow in each of said feed and stirring compartments (TC, TA, TD, 6; TA, PC, 8, PAD) of each mixing chamber, said walls including a main guide wall (6, 8) facing said perforated wall (TA, TB) and inclined relative to said perforated wall in such a manner as to extend away therefrom towards said inlet and said outlet of said mixing chamber, respectively;

said transfer means comprising at least one transfer chamber (TE, 14, 8, 16) extending along said offset direction (DC); and a succession of an even number of reversing chambers on the path of each stream of said flow, each of said chambers reversing the longitudinal components of the average speed of the fraction of said flow which flows therealong, with at least one of said reversing chambers being constituted by said transfer chamber.

* * * * *